United States Patent [19]

Gordin

[11] Patent Number: 4,816,974

[45] Date of Patent: Mar. 28, 1989

[54] GLARE CONTROL LAMP AND REFLECTOR ASSEMBLY AND METHOD FOR GLARE CONTROL

[75] Inventor: Myron K. Gordin, Oskaloosa, Iowa

[73] Assignee: Mycro Group Co., Oskaloosa, Iowa

[21] Appl. No.: 44,335

[22] Filed: Apr. 30, 1987

Related U.S. Application Data

[63] Continuation-in-part of Ser. No. 865,086, May 19, 1986, abandoned, which is a continuation of Ser. No. 687,864, Dec. 31, 1984, abandoned.

[51] Int. Cl.[4] ..... F21K 7/00

[52] U.S. Cl. ..... 362/261; 362/297; 362/346; 362/303; 313/114

[58] Field of Search ..... 362/255, 261, 262, 297, 362/298, 301, 302, 303, 304, 346, 347, 255, 256, 296, 110, 263; 313/113, 114, 117

[56] References Cited

U.S. PATENT DOCUMENTS

| | | | |
|---|---|---|---|
| 1,166,244 | 12/1915 | Norton . | |
| 1,249,133 | 12/1917 | Lebby | 362/303 |
| 1,397,803 | 11/1921 | Ensor et al. | 362/305 |
| 1,466,354 | 8/1923 | Drury | 362/298 |
| 1,560,408 | 11/1925 | Charlebois . | |
| 1,610,105 | 12/1926 | Moise | 362/298 |
| 1,639,753 | 8/1927 | Shelton | 362/282 |
| 1,660,067 | 2/1928 | Burtis | 362/298 |
| 1,691,209 | 11/1928 | Reynolds et al. . | |
| 1,751,111 | 3/1930 | Steele et al. . | |
| 1,867,138 | 7/1932 | Christmas . | |
| 1,926,675 | 9/1933 | Grunwald . | |
| 1,928,665 | 10/1933 | Irber . | |
| 1,990,666 | 2/1935 | O'Loughlin . | |
| 1,998,967 | 4/1935 | Raynolds | 362/298 |
| 2,018,155 | 10/1935 | Sahnahan . | |
| 2,221,629 | 11/1940 | Birdseye | 362/297 |
| 2,277,563 | 3/1942 | Scott et al. | 362/298 |
| 2,440,832 | 5/1948 | Pennybacker | 313/113 |
| 2,578,451 | 12/1951 | Rex . | |
| 2,826,710 | 3/1958 | Lipscomb | 313/113 |
| 3,210,536 | 10/1965 | Elmer . | |
| 3,281,620 | 10/1966 | Miller | 313/51 |
| 3,511,985 | 5/1970 | Muscovitch | 362/282 |
| 3,536,946 | 10/1970 | Kopelman et al. | 313/113 |
| 4,261,029 | 4/1981 | Mousset | 362/283 |
| 4,338,655 | 7/1982 | Gulliksen et al. | 362/281 |
| 4,341,975 | 7/1982 | Phillip et al. | 313/25 |
| 4,351,018 | 9/1982 | Fratty | 362/215 |
| 4,462,067 | 7/1984 | Altman | 362/261 |
| 4,506,315 | 3/1985 | Maekawa et al. . | |
| 4,598,348 | 7/1986 | Richter | 362/262 |

FOREIGN PATENT DOCUMENTS

| | | |
|---|---|---|
| 210185 | 1/1956 | Australia . |

*Primary Examiner*—Ira S. Lazarus
*Assistant Examiner*—D. M. Cox
*Attorney, Agent, or Firm*—Zarley, McKee, Thomte, Voorhees & Sease

[57] ABSTRACT

A glare control lamp and reflector assembly and method for glare control which includes a conventional lamp and symmetrical reflector for providing a controlled light beam to a target area. A reflector shield can be positioned on the reflector below the lamp and has the properties of diverging incident light downwardly towards the target area and thus controls reflection upwardly which would produce glare. A glare shield can be positioned on the top of the reflector and extends outwardly from the outer edge of the reflector to block both direct light and reflected light from traveling upwardly and outwardly which would produce glare. In a further combination, a lamp shield can be positioned over a portion of the outermost extending end of the lamp to prevent unreflected light from directly causing glare. A still further feature and embodiment of the invention includes an arc shield which is positioned directly adjacent to the arc of the arc lamp used with the glare control lamp and reflector assembly. The arc shield serves to block and redirect light from a short distance from the arc in an accurate and efficient manner without much loss of useful light. The arc shield can be used individually or in combination with any of the reflector shields, glare shields, and lamp shields.

13 Claims, 5 Drawing Sheets

GLARE CONTROL LAMP AND REFLECTOR ASSEMBLY AND METHOD FOR GLARE CONTROL

REFERENCE TO RELATED APPLICATION

This is a continuation-in-part of co-pending application Ser. No. 865,086 filed on May 19, 1986, now abandoned, which in turn was a continuation of then co-pending application Ser. No. 687,864 filed on Dec. 31, 1984, now abandoned.

BACKGROUND OF THE INVENTION

1. Field of Invention

This invention relates to glare control for lighting fixtures, more particularly to a means and method for controlling glare in reflector lighting units.

2. Description of Problems in the Art

In many lighting applications, there is a need for the combination of a controlled beam, with a significant amount of intensity, provided as efficiently as possible. In such applications, the conventional lamp and symmetrical reflector light fixture is the usual selection for equipment.

There are many different types of lamps and symmetrical reflectors which can be used for these applications, but a typical and detrimental problem with such lights is the glare that they produce. The higher in intensity or the more powerful the light, the higher the potential for glare.

The magnitude of the glare problem can be illustrated by specific examples. In outdoor sports lighting, the combination of the high intensity needed and the height of the suspension of the light fixtures creates glare problems not only for nearby houses and businesses, but also for persons substantial distances away. Although the level of light received at those locations is nominal, the perceived intensity caused by glare creates a bothersome nuisance to those affected. Its seriousness can include creating momentary blindness if directly looked at, which can cause serious problems with automobile traffic which may be affected by the glare.

Another example involves use of lighting on television or movie sets or the like, wherein the glare is detrimental at various camera angles for recording a scene on film.

Glare can be a problem even with the direct participants and spectators themselves, including both outdoor and indoor sports lighting, if the participant or spectator is positioned at a place which the glare directly affects, thereby affecting sight and visibility.

Thus, there is a real need in the art for means or methods of controlling glare. There are presently some attempts to provide glare control for general lighting fixtures, but no successful method is known for high intensity, controlled beam, wide area lighting units.

It is therefore an object of this invention to provide a means and method for glare control for lamp and reflector assembly lighting units which improves upon the deficiencies or solves the problems in the art.

It is a further object of this invention to provide a means and method for glare control for lamp and reflector assembly lighting units which controls glare generated by the lamp and reflector of a lamp and reflector assembly lighting unit.

A further object of this invention is to provide a reflector assembly which controls glare from a lamp and reflector lighting unit.

Another object of this invention is to provide a lamp shield which controls glare directly from the lamp of a lamp and reflector lighting unit.

A further object of this invention is to provide a means and method for controlling glare of a lamp and reflector lighting unit which is adjustable for each glare problem.

Another object of this invention is to provide a means and method for controlling glare of a lamp and reflector lighting unit which achieves glare control with a minimum reduction in the amount of light intensity reaching the target area.

Another object of the invention is to provide a means and method for controlling glare of a lamp and reflector lighting unit which utilizes maximum gathered and reflected light to present to the target area.

A further object of this invention is to provide a means and method for controlling glare of a lamp and reflector lighting unit which is adjustable in design, economical, and durable.

Another object of this invention is to provide a means and method for controlling glare of a lamp and reflector lighting unit which can be retrofitted to existing lamp and reflector lighting units.

These and other features, objects, and advantages of the invention will become apparent to those skilled in the art with reference to the accompanying specification.

SUMMARY OF THE INVENTION

This invention utilizes a specialized reflector assembly in a lamp and reflector lighting unit to control glare from the lighting unit. A conventional lighting unit generally consists of a lamp socket, a lamp operatively mounted therein, and a symmetrical reflector in association with the lamp to provide a controlled light beam from the light of the lamp to a target area.

One means and method for controlling glare according to the invention consists of a reflector assembly comprised of the conventional symmetrical reflector, a reflector shield and a glare shield.

The reflector shield comprises a piece of reflective material which is mounted or positioned beneath the lamp on the bottom half of the interior surface of the conventional converging symmetrical reflector. The reflector shield is in effect a diverging reflector in that it diverts all incident light upon it downwardly towards the target area and thereby prevents incident light, whether direct or reflected, from projecting upwardly and outwardly and therefore producing glare.

The reflector shield can cover up to approximately the entire bottom half of the interior of the reflector, or can cover an angular section thereof depending on requirements.

A glare shield is mounted or positioned around the peripheral edge of the reflector, usually the upper one-half or more of the reflector. The glare shield extends outwardly from the peripheral edge of the reflector and serve to block light, whether direct or reflected from the lamp, from traveling upwardly and outwardly and causing glare. Additionally, the glare shield diverts substantial incident light downwardly towards the target area.

An additional embodiment of the invention involves utilization of a lamp shield to further reduce and control glare. The lamp shield is mounted or positioned over the upper part of the outwardmost end of the lamp to prevent and block directly emanating light, which can cause glare. The major purpose of the lamp shield is to force as much as possible, the light emanating from the lamp to be reflected from either the reflector or the reflector shield. The lower part of the end of the lamp is left uncovered because the directly emanating light would mostly be directed to the target area.

A still further feature and embodiment of the invention includes an arc shield which is positioned on or closely adjacent to the arc of the arc lamp used with the invention. By selective positioning and size of the arc shield, light can be blocked and/or redirected from a very close distance to the arc in a very efficient, accurate and non-wasteful manner. The arc shield can be comprised of a separate piece secured to the arc tube. It can also take other forms such as an opaque and/or reflective coating inside or outside the arc tube. The arc shield can be used independently or in combination with any of the other glare and spill light controlling elements of the invention such as reflector shields, glare shields and lamp shields.

The method of controlling glare includes the steps of providing the conventional lamp and reflector lighting unit with a glare shield, reflector shield, lamp shield, or arc shield, or any combination thereof, depending upon the nature of the glare which is required to be controlled. This includes retrofitting existing lighting units to control glare.

BRIEF DESCRIPTION OF THE DRAWINGS

FIG. 25 is a perspective view of an alternative embodiment of the invention utilizing a glare shield and supplemental glare shield.

DETAILED DESCRIPTION OF THE PREFERRED EMBODIMENT

Figure 1:
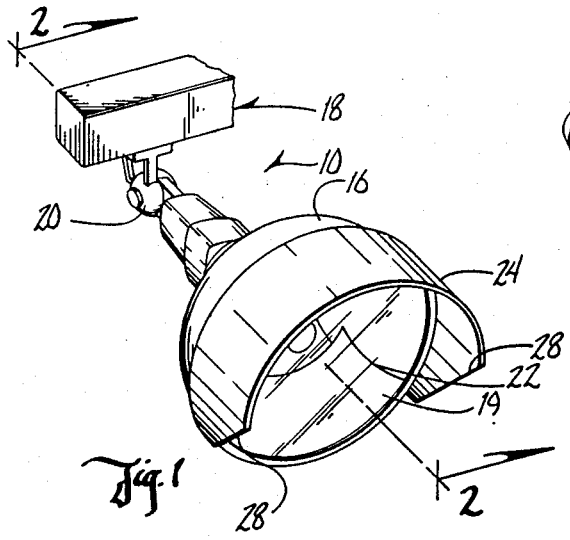
FIG. 1 is a perspective view of one embodiment of the glare control assembly.

In reference to the drawings, and in particular FIG. 1, there is shown a glare control lamp and a reflector assembly 10 in accordance with the invention. The assembly 10 consists first of a lamp 12 operatively connected and secured to a lamp socket 14. A conventional symmetrical reflector 16 surrounds lamp 12 to provide a controlled beam of light. Symmetrical reflector 16 is a converging reflector in both its upper and lower hemispheres, meaning that reflector 16 causes the light reflected from it to emanate in a converging manner.

As is conventional, lamp socket 14 is adjustably mounted to a support 18 by a vertically and horizontally adjustable connecting elbow 20. Likewise, conventionally, a transparent cover 19 is placed over lamp 12 and reflector 16.

A reflector shield 22 is mounted on the lower surface of reflector 16, beneath lamp 12. Reflector shield 22 is of such configuration that it forms a diverging reflecting surface thus transmitting incident light divergingly downward.

A glare shield 24 is mounted perimetrically around the circumferential perimeter of the upper portion of reflector 16 and extends outwardly therefrom. Glare shield 24 blocks light emanating directly out of lamp 12 and reflecting off of reflector 16 from traveling upwardly and outwardly and thus reduces glare. Glare shield 24 also prevents waste of dissipated upward light and concentrates the light where it is needed, on the target area.

The combination of reflector shield 22 and glare shield 24 serves to control direct and reflected light from lamp 12 and reflector 16 to minimize light being directed away from the target area, and more particularly, to prevent light from traveling upwardly and outwardly, which produces the most glare.

Figure 2:
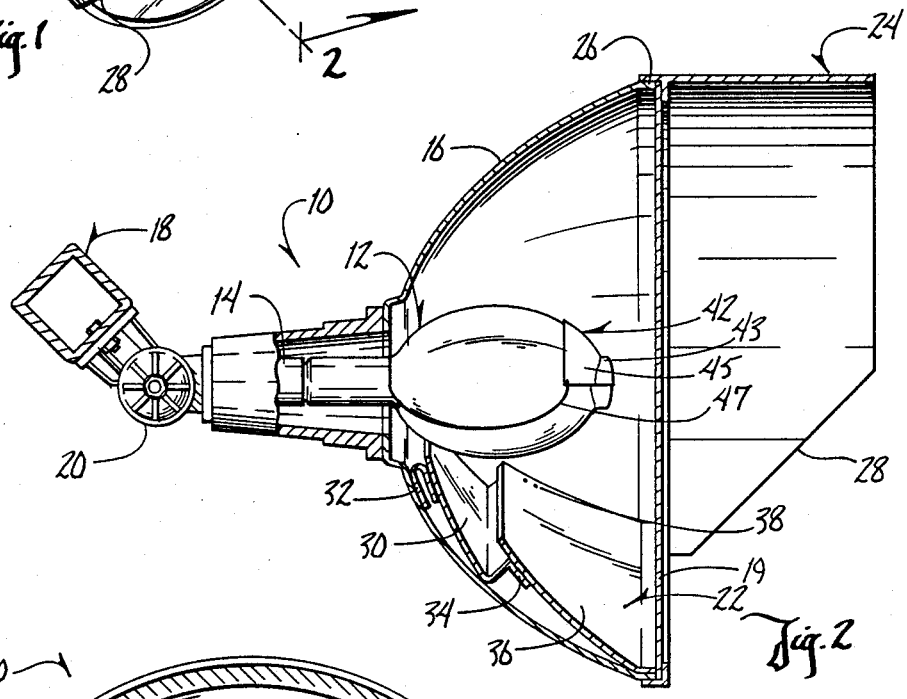
FIG. 2 is a sectional view taken along line 2—2 of FIG. 1.

By referring to FIG. 2, the exact structure of this embodiment of invention 10 can be more clearly seen. Glare shield 24 can extend around the upper hemisphere of reflector 16. Exactly how far glare shield 24 extends depends on the glare control needed, therefore, it can extend less than or greater than 180° of its circumference according to choice and needs. Lip 26 is mateable around the exterior of reflector 16 allowing secure mounting of glare shield 24 with no gaps. Beveled edges 28 of glare shield 24 further prevent glare from the sides of invention 10, and yet allows maximum light to reach the target area.

FIG. 2 shows a first embodiment of reflector shield 22. Because of the close distance between reflector shield 22 and lamp 12, a very shallow reflection angle is formed between the two, especially at the end of reflector shield 22 nearest lamp 12. Therefore, it has been found that a two-part stepped reflector shield 22 can be effectively used. An inner section 30 is mounted by U-shaped bracket 32 to the interior of reflector 16 at the required reflection orientation to lamp 12. Inner section 30 has an inverted L-shaped outer edge 34, which in turn supports outer section 36 of reflector shield 22. The size of L-shaped outer edge 34 is such that it holds outer section 36, which is attached at its outer edge to the interior outer edge of reflector 16, at such an orientation as to achieve the proper reflection angle with respect to lamp 12.

Figure 3:
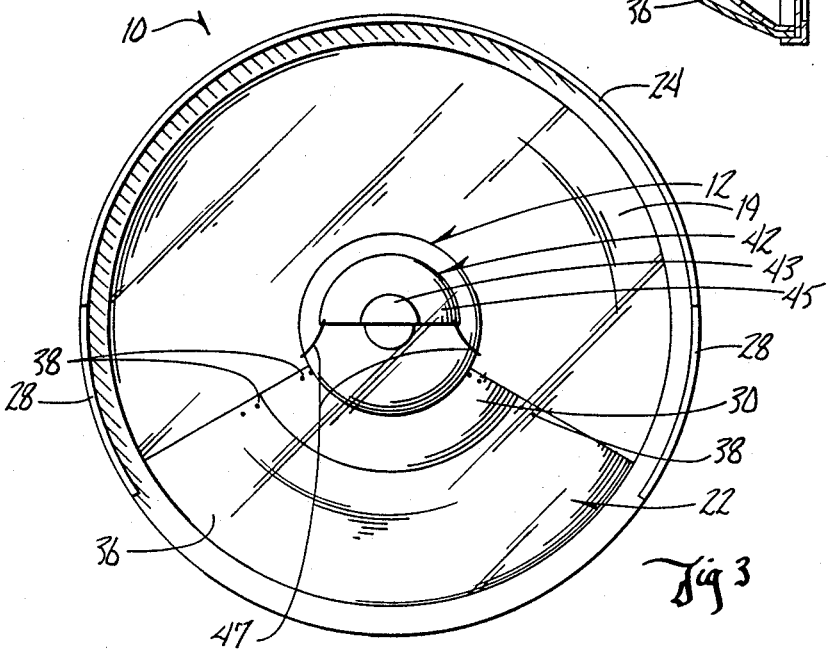
FIG. 3 is a front elevational view of the embodiment of FIG. 2.

The function of reflector shield 22 is to control glare by diverging incident light downwardly towards the target area, instead of allowing reflected light from the bottom of the symmetrical converging reflector to be directed upwardly and outwardly, a prime cause of glare. FIG. 3 shows a front elevational view of the two section reflection shield 22 of FIG. 2. By nature of the size, configuration, and glare controlling properties of glare shield 24, it is preferred that reflector shield 22 occupy an angular section of 180° or less of the interior of reflector 16. In the embodiments shown in the drawings, the angular section is approximately 120°. Angular sections of less than 180° are desired to maximize the amount of gathered and reflected light from lamp 12. Inner and outer sections 30 and 36 of reflector shield 22 can be attached to one another and to reflector 16 by means of rivets 38 or can be otherwise attached or spun into one continuous shape.

It is to be noted that reflector shield 22 can be made of any material which has good reflective qualities and which can withstand the heat produced by high intensity lamps. Aluminum is a preferred material.

Figure 6:
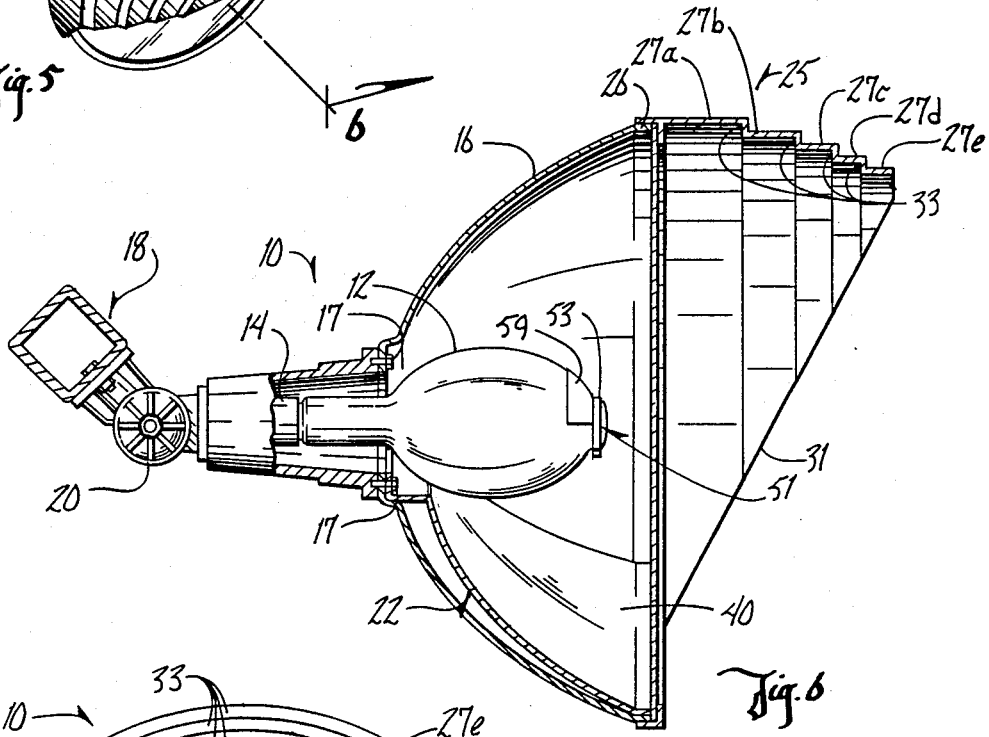
FIG. 6 is a sectional view taken along lines 6—6 of FIG. 5 showing alternative embodiments of the glare shield, reflector shield, and lamp shield.
Figure 7:
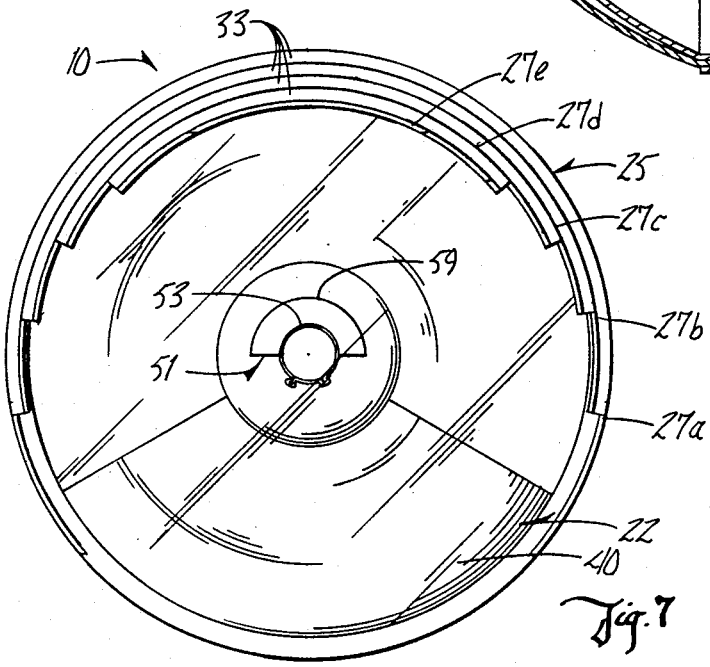
FIG. 7 is a front elevational view of the assembly of FIG. 6.

A second embodiment of reflector shield 22 is depicted in FIGS. 6 and 7. Instead of a two-piece configuration, reflector shield 22 could be constructed from a one-piece member 40, which is mounted to, and held in the correct reflective orientation with respect to lamp 12 by U-shaped bracket 32, and any mounting means known in the art. Alternatively, it could be attached to the base of reflector 16 by the very bolts or screws 17 used to attach reflector 16 to lamp socket 14, as seen in FIG. 3.

Figure 5:
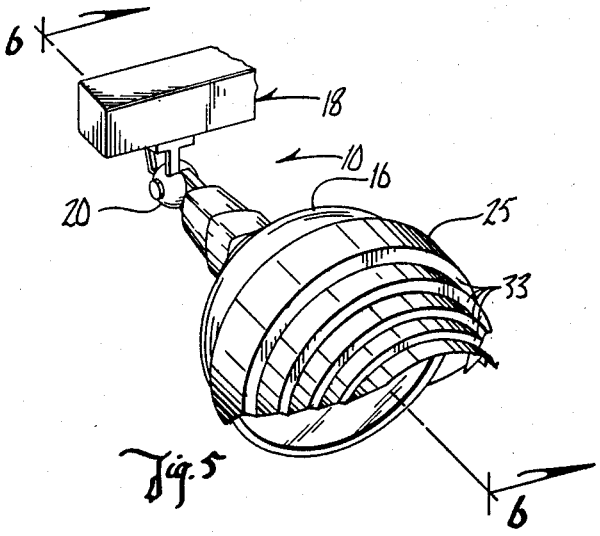
FIG. 5 is a perspective view of another embodiment of the glare control assembly.

FIGS. 5, 6, and 7 also show an alternative embodiment of the glare shield, here referred to as stepped glare shield 25. Stepped glare shield 25 is the preferred embodiment because it causes more light to be redirected to the target area and allows the lamp shield to be smaller, as is discussed below, thus further allowing more light to reach the target area. By referring to FIGS. 5 and 7, it can be seen that stepped glare shield 25 has an angled edge 31 along its side which determines the glare cut-off point. Each step in the glare shield referenced by numerals 27*a–e* has a decreasing diameter and is attached to the preceding step by brackets 29. Each step 27*a–e* is a flat curved piece and can be of varying widths. A corresponding curved vertical piece 33 is secured between adjacent steps 27*a–e*. Alternatively, stepped glare shield could be manufactured as one piece.

Figure 4:
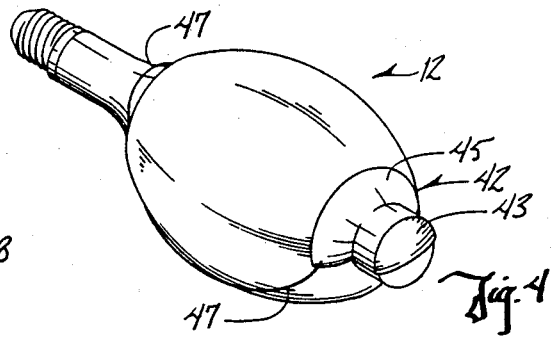
FIG. 4 is a perspective view of a lamp with one embodiment of a lamp shield mounted thereon.

The drawings also depict embodiments of an additional feature of the invention which can be employed to further control glare. A first embodiment of a lamp shield is shown in FIGS. 2, 3 and 4 by reference numeral 42. A second embodiment is referred to by numeral 51 in FIGS. 6, 7 and 8.

A lamp shield can be placed either directly upon or in association with the outer end of lamp 12. By covering the upper part of the outer end of lamp 12, as shown, directly emanating light from that part of lamp 12 is blocked and reflected forcing the light to be directed to the reflecting surfaces of the assembly 10. This blockage of directly emanating light from the end of lamp 12 further enhances glare control.

Lamp shield 42 is shown on lamp 12 in FIG. 4 and in operation in FIGS. 2 and 3. A nose piece 43 covers and encloses the upper part of the nose end of lamp 12. A fan shaped, curved portion 45 extends rearwardly of nose piece 43 and covers an angular section of the front top of lamp 12. A wire 47 is attached at opposite lateral sides of portion 45 and extends around the back of the upper side of lamp 12 to support and keep lamp shield 42 in place.

Figure 8:
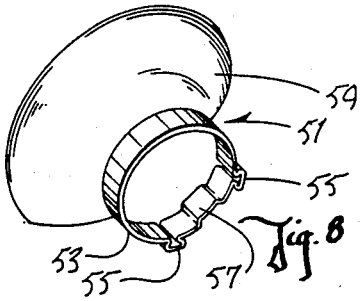
FIG. 8 is a perspective view of an alternative embodiment of the lamp shield.

Lamp shield 51 of FIGS. 7 and 8 utilizes a full band 53 to secure it to lamp 12. Bent portions 55 and 57 provide retentive spring action to band 53. Portion 59 is similar to portion 45 of lamp shield 42. Other methods for retaining the lamp shield to lamp 12, such as are known in the art, could also be used.

It is to be understood that lamp shield 42 or 51 covers an angular section of the outer end of lamp 12, generally between 120° and 180° of the upper part of the upper end of lamp 12. The lamp shields 42 and 51 shown in the drawings cover approximately 180° of the end of lamp 12. The exact angular section covered by the lamp shield is determined by the amount and kind of glare control needed and is coordinated with the size and coverage of the glare shield. It is generally between 180° and 120° but could be an even smaller angular section, depending on the glare shield used. The lamp shield is made of a material that is reflective, and which can withstand high temperature, such as aluminum. The major purpose of lamp shields 42 and 51 is to block and redirect light emanating directly from the end of lamp 12 which would project upwardly and outwardly from invention 10 without being reflected by glare shield 24, and at the same time to prevent direct out-of-sight glare. Therefore, depending upon the nature of the glare problems, lamp shield 42 can be tailored to a desired configuration.

In certain rare instances, or on an emergency, temporary basis, the lamp shield can be made to cover the entire outer end of lamp 12 by simply painting the end with a high temperature black or reflective paint, such as is commercially available. The entire end must be painted because the exact final orientation of lamp 12 in socket 14 is not known as lamp 12 is screwed into place.

In operation, the invention 10 functions as follows. Depending upon the nature of the glare problem, a reflector shield 22, glare shield 24 (or 25), or lamp shield 42 (or 51) can be used as desired. Used individually, each would control a portion of glare emanating from lamp 12 and reflector 16. Glare shield 24 (or 25) would block and redirect any light angling extremely upwardly and outwardly from lamp 12 and reflector 16, and thereby reduce glare in that manner. Reflector shield 22 would direct any light incident upon it divergingly downward and thus reduce reflected light leaving reflector 16 upwardly and outwardly, thus reducing glare. Lamp shield 42 (or 51) would block and redirect light emanating directly from the end of lamp 12, and in particular, any light emanating directly upwardly and outwardly, thereby reducing glare.

Combining any of the reflector shield 22, glare shield 24 (or 25), and lamp shield 42 (or 51) would further control glare. Glare shield 24 (or 25), in cooperation with either reflector shield 22 or lamp shield 42 (or 51), or both, would serve to additionally prevent light from escaping lamp 12 and reflector 16 upwardly and outwardly.

It will be appreciated that the present invention can take many forms and embodiments. The true essence and spirit of this invention are defined in the appending claims, and it is not intended that the embodiment of the invention presented herein should limit the scope thereof. For example, the exact manner of attachment and configuration of glare shield 24, reflector shield 22, and lamp shield 24 can vary within the scope of the invention.

It is also to be understood that a major advantage of the invention is that the addition of any of reflector shield, glare shield, or lamp shield, can be accomplished either in original manufacturing of the invention 10, or by retrofitting it to existing lamp, lamp socket, and reflector assemblies. Many glare problems exist with recently operating conventional lighting units. After determining the nature of the glare problem, it can be controlled by utilizing the present invention. Reflector glare and/or lamp shields can be retrofitted to the existing lamp and reflector, or a new lamp or reflector can be utilized with any of those elements installed.

It may occur that an existing reflector may not reflect light convergingly in both upper and lower hemispheres. It is to be understood that the invention requires only that a predetermined angular section (usually less than 180°, and preferred to be around 120°) in the lower hemisphere of the reflector cause diverging reflection; and that the remaining portion of the reflector cause converging reflection. Thus, if the reflector is diverging in its upper hemisphere, a retrofit converging reflector shield can be installed. Conversely, if the lower hemisphere is originally diverging, a diverging reflector shield may not be needed. To avoid extensive modification, the reflector can simply be replaced with one capable of easy modification in accordance with the invention.

Figure 9:
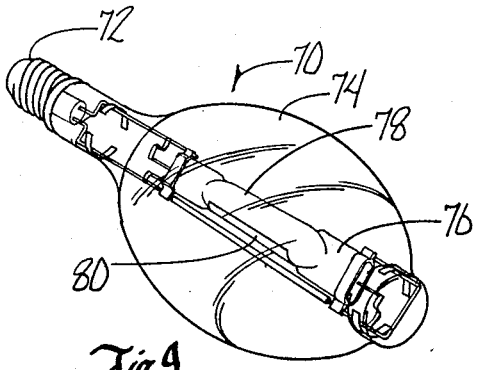
FIG. 9 is a perspective view of an arc lamp including an arc shield according to an alternative embodiment and feature of the invention.

FIGS. 9 through 24 depict a still further feature and alternative embodiment for the invention. By referring specifically to FIGS. 9–11, it can be seen that an arc lamp 70 such as can be used in the lighting units shown in FIGS. 1–8, consists of a screw-in connector 72, a transparent glass bulb 74 which encloses an arc tube 76. The lighting arc is positioned in an enlarged portion 78 of arc tube 76 generally in the middle of bulb 74.

Figure 10A:
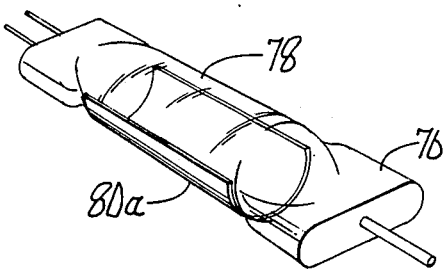
FIG. 10A is an isolated perspective view of the arc tube of FIG. 9 with the arc shield attached.
Figure 11:
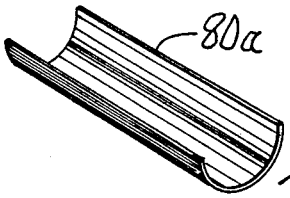
FIG. 11 is an isolated perspective view of the arc shield of FIGS. 9 and 10A.
Figure 10B:
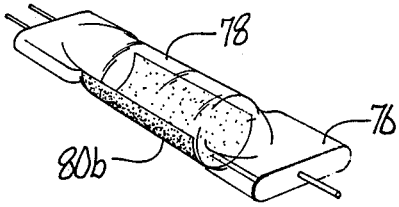
FIG. 10B is an alternative embodiment of the arc tube of FIG. 9 having the arc shield made from a coating of material.
Figure 15:
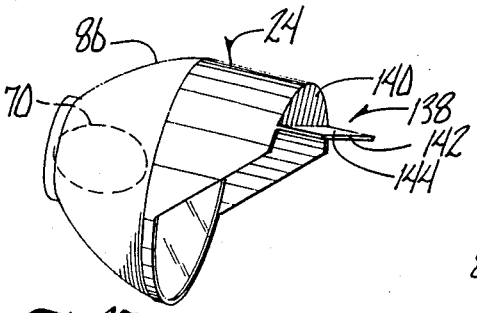

An arc shield 80 is positioned on or directly adjacent to enlarged portion 78 of arc tube 76 to block and/or redirect light emanating from the arc created by arc lamp 70. As shown in FIGS. 10A and 11, arc shield 80A can be a separate piece of material which is secured to arc tube 76. As an alternative, and as shown in FIG. 10B, arc shield 80B could be a coating of material applied to the arc tube 76. It is to be understood that arc shield 80 can be made of a number of different materials, can be applied directly to arc tube 76 on the outside or inside, and can have any number of reflective properties.

By being able to control and redirect light very close to the arc itself, accuracy of placement and direction of the light is enhanced, and loss of light is decreased.

Figure 12:
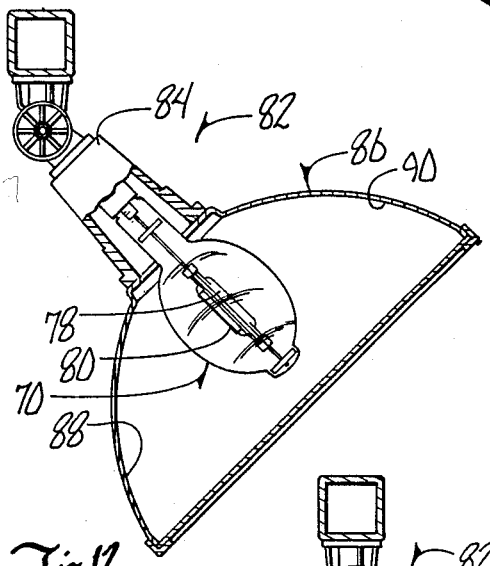
FIG. 12 is a cross-sectional elevational view of the arc lamp of FIG. 9 operatively connected to a lighting fixture including a symmetrical reflector.
Figure 13:
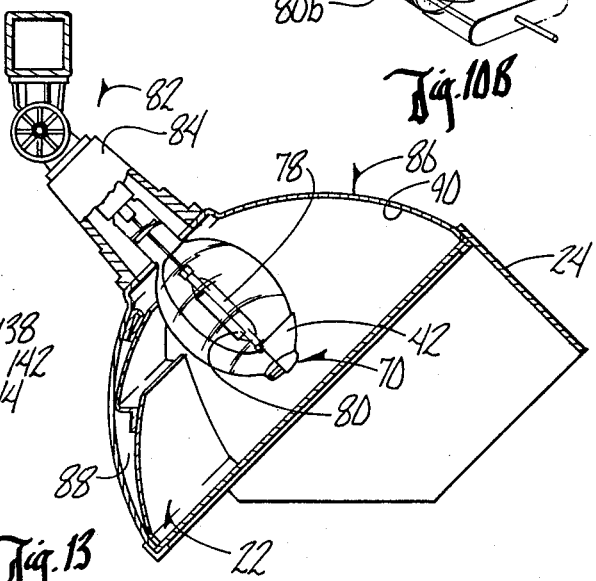
FIG. 13 is a similar view to that of FIG. 12 additionally including a glare shield, a reflector shield, and a lamp shield.

FIGS. 12 and 13 show how arc shield 80 can be used with arc lamp 70 being operatively connected to a lighting fixture 82 having mounting socket 84 and reflector 86. Arc shield 80 would block light from arc lamp 70 from emanating to the lower hemisphere reflecting surface 88 of reflector 86, and redirect it to upper hemisphere reflecting surface 90. Essentially, all the light would therefore be convergingly reflected from upper hemisphere 90 downwardly to a target area. Such a configuration would eliminate upward reflection from lower hemisphere 88 away from the target area, and control or eliminate glare.

Arc shield 80 could therefore produce the same light controlling capabilities of reflector shield 22 of FIGS. 2 and 3 in a simpler and more accurate manner.

FIG. 13 shows how arc shield 80 could be used in selective combination with reflector shield 22, glare shield 24, and/or lamp shield 42. Shields 22, 24, and 42 would operate as previously described. Use of arc shield 80 would allow immediate and more accurate control of the light from arc lamp 70 while combining those properties with the glare and spill light control capabilities of shields 22, 24, and 42. As previously stated, appropriate configuration and positioning of arc shield 80 might eliminate the need for reflector shield 22. It is to be understood that arc shield 80 can be used singly to control light and glare, or with any combination of reflector shield 22, glare shield 24, and lamp shield 42. Each of these light controlling elements can selectively be chosen according to the specific lighting characteristics and glare or spill light problems for the lighting unit and target and surrounding areas.

Figure 14A:
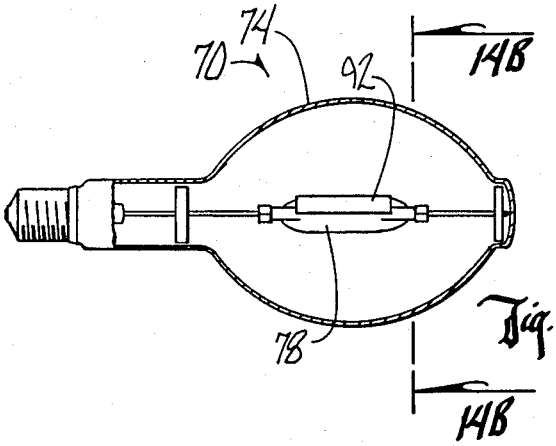
FIGS. 14A and B through 18A and B are cross-sectional elevational and end views depicting various orientations and shapes of arc shields.

FIGS. 14A and B–19A and B depict a few examples of different shapes and orientations for arc shield 80. FIGS. 14A and B show an arc shield 92 which is generally semicircular in cross-section and is positioned on top of enlarged portion 78 of arc tube 76. It would then serve to block and redirect light downwardly.

Figure 15A:
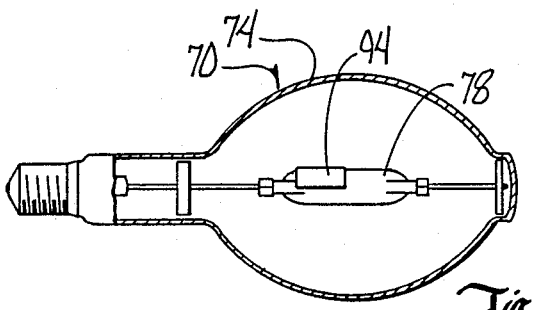
Figure 15B:
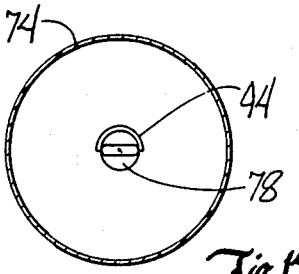

FIGS. 15A and B show an arc shield 94 which can cover only a portion of the enlarged portion 78 of arc tube 76, blocking and redirecting some of the light emanating from arc lamp 70 but not interferring with the remaining portion.

Figure 16A:
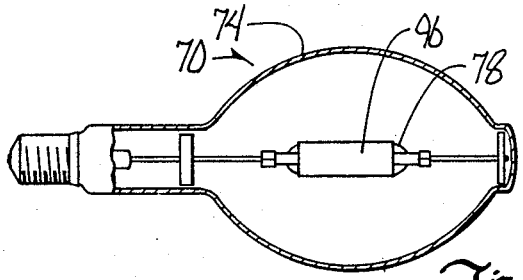
Figure 16B:
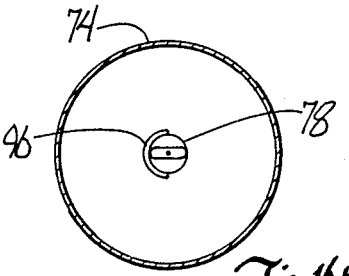

FIGS. 16A and B show an arc shield 96 which is positioned on the side of arc tube 76 to block and redirect light to the side of arc lamp 70.

Figure 14B:
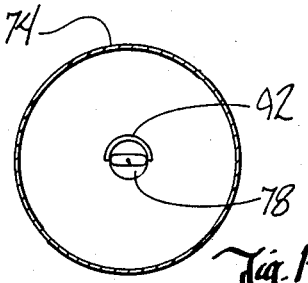
Figure 17A:
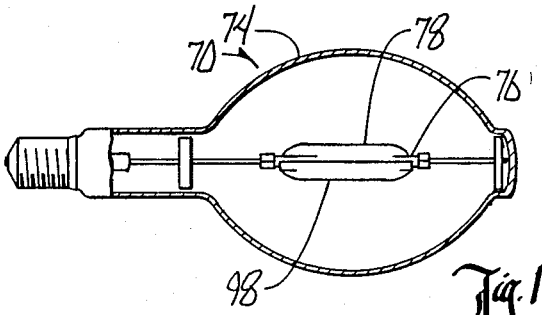
Figure 17B:
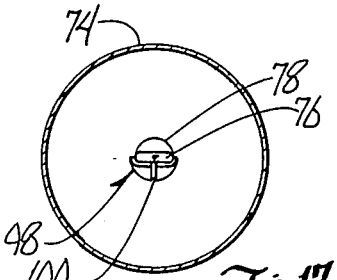

FIGS. 17A and B show an arc shield 98 which similarly to arc shield 92 of FIG. 14 covers the top of enlarged portion 78 of arc tube 76. However, arc shield 98 has an open slot 100 down its center and has front and rear ends 102 and 104 which extend a little further over the ends of enlarged portion 78. The primary purpose of arc shield 98 would be to block and redirect most of the light emanating upwardly from arc lamp 70, but allow a portion through slot 100 to pass through. A practical application of this type of arc shield would be as follows. If arc shield 98 were placed on the bottom of arc tube 76, and arc lamp 70 operatively connected to a lighting fixture such as shown in FIG. 12, and the lighting fixture was used, with a plurality of the same lighting fixtures to light an athletic field, most of the light would be allowed to emanate upwardly from arc lamp 70, be reflected by the upper hemisphere 88 of reflector 86, and directed downwardly onto the athletic field. Open slot 100, however, would allow a portion of light to go to lower hemisphere 90 and be directed upwardly and outwardly so as to give some illumination to the area above the lights and directly above the playing field. Balls or objects that were thrown or hit into this upper area would then still be sufficiently illuminated so that the players and spectators could maintain visual tracking of the object. By allowing only a little light into this upper area, glare problems could still be controlled.

Figure 18A:
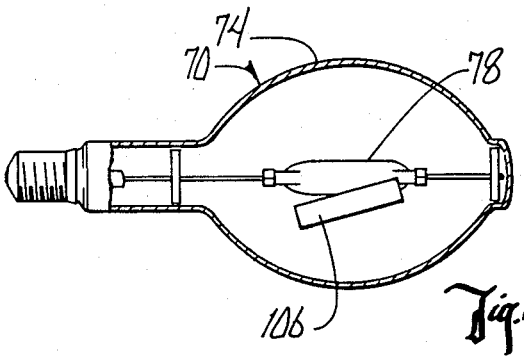
Figure 18B:
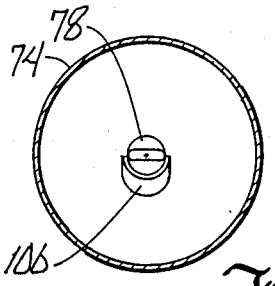

FIGS. 18A and B simply show that arc shield 106 does not necessarily need to be in abutment with arc tube 76 or in any parallel or required orientation.

Figure 19A:
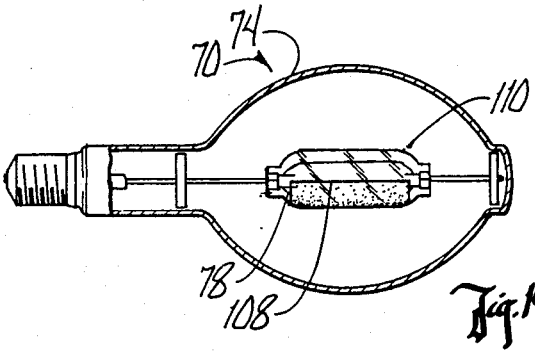
FIGS. 19A and B are side elevational and an end view of an arc tube being encapsulated by a secondary transparent tube which has an arc shield positioned on its inside surface.
Figure 19B:
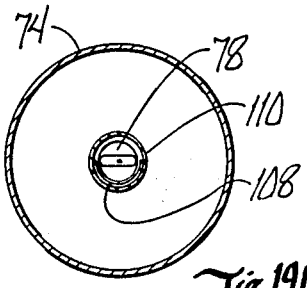

FIGS. 19A and B depict an arc shield 108, which instead of being directly adjacent to or in abutment with arc tube 76, is secured to a transparent enveloping insulating tube 110 which is secured over and around enlarged portion 78 of arc tube 76. Enveloping insulating tube 110 encloses and encapsulates arc tube 76 and at the same time positions arc shield 108 a little further away from arc tube 76 and presents some thermal insulation to reduce the chance of heat damaging or otherwise causing arc shield 108 to fail or deteriorate. It is believed that the best arc shield 108 would be a coating adhered to the inside of enveloping insulating tube 110. Other arc shields 108, are possible. It is also to be understood that it is believed the best arc shield would be one which reflects light but transmits infrared (heat) radiation. If arc shield 110 is made of aluminum or some other solid material, it is believed that enveloping insulating tube 110 would have to be as large as possible to prevent melting or damage to such a shield 110.

Figure 20:
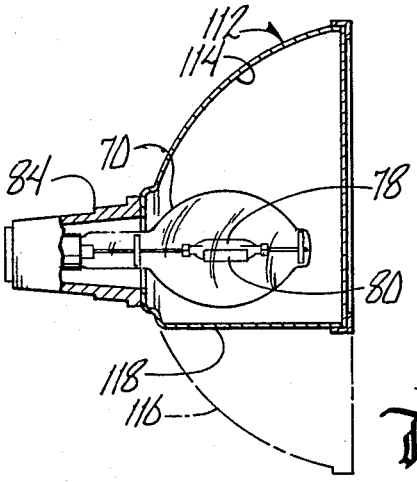
FIG. 20 is a cross-sectional elevational view of an alternative embodiment of the invention utilizing an arc shield which allows elimination of the bottom part of the symmetrical reflector as shown by ghost lines.

FIG. 20 illustrates an alternative reflector 112, which could be utilized with arc lamp 70 utilizing arc shield 80. Because arc shield 80 blocks and redirects light which would have become incident on the lower hemisphere of a symmetrical reflector such as shown in FIG. 12, reflector 112 of FIG. 20 need only have an upper hemisphere 114. Lower hemisphere 116 is unnecessary as shown in ghost lines. A wall 118 can simply be placed between the front and rear of reflector 112 below arc lamp 70.

Figure 21:
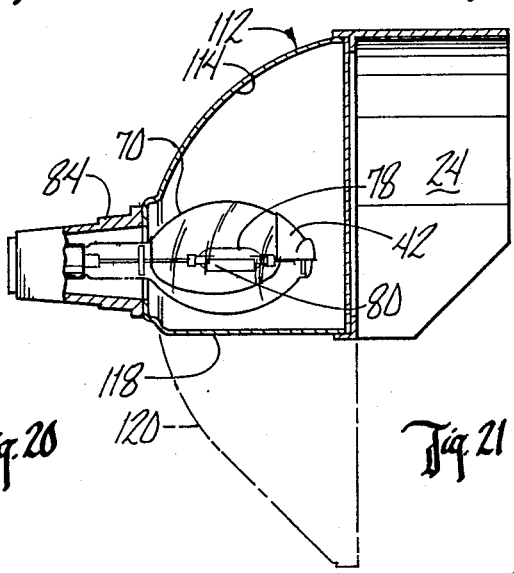
FIG. 21 is a cross-sectional elevational view of an alternative embodiment of the invention similar to FIG. 20 with attached glare shield and lamp shield, and showing in ghost lines the elimination of a lower hemisphere diverging reflector because of the arc shield.

Likewise, FIG. 21 shows the use of reflector 112 with arc lamp 70 having arc shield 80, and application of glare shield 24 and lamp shield 42. Additionally, ghost lines 120 schematically depict a lower hemisphere of reflector 112 which is made unnecessary by arc shield 80. Ghost lines 120 show that without arc shield 80, the reflecting properties of the lower hemisphere must be diverging. Thus, it would require a much longer, different, reflecting surface from the upper hemisphere. This would increase the area of reflector 112 which is generally disadvantageous because it greatly increases wind load on such a lighting fixture. Arc shield 80 with reflector 112 eliminates this problem. It also eliminates the extra structure of reflector shield 22 as used with the embodiment explained with respect to FIGS. 2 and 3.

Figure 22:
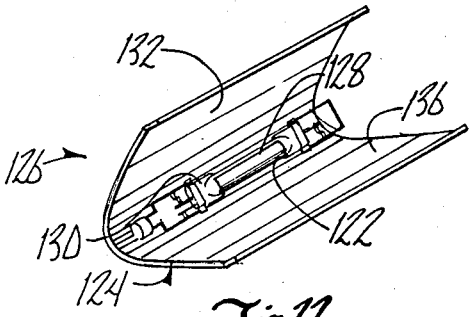
FIG. 22 is a schematic perspective view showing application of the arc shield to an asymmetrical arc lamp and reflector combination.
Figure 23:
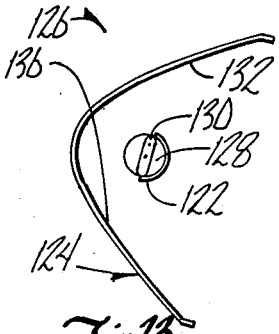
FIG. 23 is an end view of FIG. 22.
Figure 24:
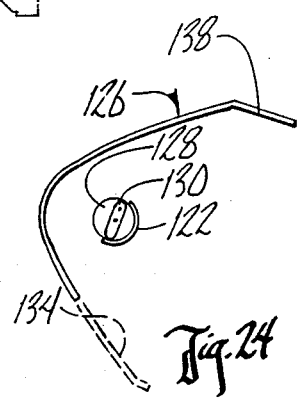
FIG. 24 is a schematic end view of an alternative embodiment of FIG. 22 showing in ghost lines an unneeded downwardly diverging lower reflector portion because of the arc shield.

FIGS. 22–24 show application of an arc shield 122 to a different arc lamp 124 used in association with an asymmetrical reflector 126. Similar results occur with respect to utilizing arc shield 122 over enlarged portion 128 of arc tube 130 where the arc for the lamp is created. Application of arc shield 122 as shown in FIGS. 22–24 would block and redirect light emanating downwardly from arc tube 130 and cause most of the light to be reflected downwardly from the upper half 132 of reflector 126 so that it can be accurately directed downwardly to a target area. FIG. 24, similarly to FIG. 21, shows in ghost lines 134 that lower one half 136 of reflector 126 could be removed when using arc shield 122. Ghost lines 134 also show that without arc shield 122, the reflecting characteristics and shape of reflector 126 would have to be altered so that lower one half 136 would be diverging. Again, this would greatly increase the surface area of reflector 126 disadvantageously because of wind load. Redirection and control of light directly at the arc tube 130, again also reduces loss of light or dissipation which occurs when light has to travel to a larger reflective surface and then be redirected.

It can therefore be seen that utilization of an arc shield can be independently used to control light and to control glare and spill light problems. Additionally, an arc shield can eliminate or at least reduce the need to deal with light redirection problems at the bottom of the reflector, in the embodiment shown in FIGS. 20–24. Light is captured and redirected as close to the source as possible. Additionally, utilization of such features as reflector shield 22, would still result in some glare problems. Arc shields may allow elimination of this problem, and even elimination of the lower portion of the reflectors.

Use of arc shields also allows the light from the arc lamp to be captured sooner than it is generally captured on conventional reflectors. Control and efficiency of the light is increased because by capturing the light sooner, it eliminates much of the potential problems of light ending up where it is not supposed to, as can occur in the more conventional reflectors.

It is also to be understood that arc shields are easily retrofittable upon existing arc lamp fixtures. Instead of altering or removing the bottom half of the reflector, it could be painted black.

It is also understood that with proper design, the arc shield has the ability to selectively redirect light through the arc tube so as to create a more uniform heating of the arc tube wall. This condition allows more of the halide compounds to remain in suspension instead of precipitating out at the cooler areas of the arc tube. This would result in more light being produced and emanated from the arc lamp further increasing its efficiency.

The arc shields can be made of many types of materials. Aluminum oxide could be used to create the arc shield as a coating on the outside of the arc tube. They may be made of stainless steel which is lined with a high temperature ceramic material. The ceramic material may be very white, which is the optimal reflective surface. Generally, the arc shield should be reflective and capable of withstanding the environmental temperature during operation of the arc lamp. It can be specular or diffuse, or any range in between, according to desire.

FIG. 25 shows an optional modification to glare shield 24 as discussed with respect to FIG. 2. A supplemental glare shield 138 can optionally be attached to the upper and outermost extending part of glare shield 24. An attachment part 140 is secured by means known within the art to the outer lip 142 of glare shield 24. An extension part 144 extends outwardly from attachment part 140 and serves to further block and/or redirect light which may be directed upwardly and outwardly.

It is to be understood that supplemental glare shield 138 could be formed into one glare shield 24. However, in certain applications, supplemental glare shield 138 would be needed for only a few of lighting fixtures and therefore could be selectively added as needed and desired.

The included preferred embodiments are given by way of example only, and not by way of limitation to the invention, which is solely described by the claims herein. Variations obvious to one skilled in the art will be included within the invention defined by the claims.

What is claimed is:

1. A means for directing light from an arc of an arc lamp comprising:

arc shield means positioned adjacent to the arc of said arc lamp to block and redirect light emanating directly from said arc lamp;

a luminaire assembly unit including a reflector with reflective surfaces, the reflective surfaces being positioned only in those areas in relationship to said arc tube which are opposite from and which receive light from said arc tube and arc shield means.

2. A method of reducing the area of the reflector of a luminaire assembly unit, said luminaire assembly unit comprising an arc of an arc lamp having an arc tube positioned generally at or near the focus of a reflector comprising:

positioning an arc shield means adjacent to the arc of said arc lamp to block and redirect light emanating directly from said arc lamp;

positioning a reflective surface only in those areas in relationship to said arc tube which are opposite from and which receive light from said arc tube and arc shield means.

3. A means for directing light from an arc of an arc lamp comprising:

arc shield means positioned adjacent to the arc of said arc lamp to block and redirect light emanating directly from said arc lamp;

a luminaire assembly unit having a reflector with a circular perimeter edge, said arc lamp being mounted centrally in said reflector for providing controlled light to a target area;

a glare shield reflector removably positioned on said reflector perimeter edge and extending outwardly from the top of said reflector to block and reflect incident light of said arc lamp and reflector downwardly;

a removable lamp shield of conforming shape to said arc lamp positioned in intimate covering relationship with a portion of said arc lamp to block a portion of light emanating directly from said lamp;

a diverging reflector shield removably positioned on said symmetrical reflector below said lamp and reflector to be directed divergingly downward and to prevent incident light from being reflected upwardly and a supplemental glare shield removably positioned on the outward edge of said glare shield reflector, extending outwardly from the outer end of said glare shield reflector.

4. The means of claim 3 wherein said arc lamp comprises a transparent arc tube enclosing an arc chamber wherein an arc is created, a transparent bulb enclosing said arc tube, electrodes to create said arc, and means for securing said arc tube within said bulb for removably mounting said arc lamp in a fixture, and for conducting electrical power to said electrodes.

5. The means of claim 3 wherein said arc shield means comprises a member securable in a position adjacent said arc.

6. The means of claim 3 wherein said arc shield means comprises a coating on an arc tube encasing said arc.

7. The means of claim 3 wherein said arc shield means is light impermeable.

8. The means of claim 3 wherein at least a portion of said arc shield is reflective.

9. The means of claim 8 wherein at least a portion of said arc shield means facing said arc is reflective.

10. The means of claim 4 wherein said arc tube is generally circular in cross-section and said arc shield means generally conforms to the curved perimeter of said arc tube.

11. The means of claim 3 wherein said arc shield means is positionable and can extend over any portion of said arc.

12. The means of claim 3 further comprising:

a luminaire assembly unit having a reflector with a circular perimeter edge, said arc lamp being mounted centrally in said reflector for providing controlled light to a target area.

13. The means of claim 3 further comprising a luminaire assembly unit having a reflector of a convex shape, said arc lamp being mounted along said axis of said reflector.

* * * * *